US006792118B2

(12) United States Patent
Watts

(10) Patent No.: US 6,792,118 B2
(45) Date of Patent: Sep. 14, 2004

(54) COMPUTATION OF MULTI-SENSOR TIME DELAYS

(75) Inventor: Lloyd Watts, Mountain View, CA (US)

(73) Assignee: Applied Neurosystems Corporation, Mountain View, CA (US)

( * ) Notice: Subject to any disclaimer, the term of this patent is extended or adjusted under 35 U.S.C. 154(b) by 271 days.

(21) Appl. No.: 10/004,141

(22) Filed: Nov. 14, 2001

(65) Prior Publication Data

US 2003/0095667 A1 May 22, 2003

(51) Int. Cl.[7] ..... H04R 3/00
(52) U.S. Cl. ..... 381/92; 348/14.01
(58) Field of Search ..... 381/92, 56; 367/125, 367/127, 118, 119

(56) References Cited

U.S. PATENT DOCUMENTS 4,581,758 A * 4/1986 Coker et al. ..... 381/56
5,058,419 A * 10/1991 Nordstrom et al. ..... 73/40.5 A
5,729,612 A 3/1998 Abel et al. ..... 381/56
6,223,090 B1 4/2001 Brungart ..... 700/28
6,516,066 B2 * 2/2003 Hayashi ..... 381/92

OTHER PUBLICATIONS

Jeffress, Lloyd A., "A Place Theory of Sound Localization", The Journal of Comparative and Physiological Psychology, 1948, vol. 41, p. 35–39.
Lazzaro, John and Mead, Carver A., "A Silicon Model of Auditory Localization", Neural Computation 1, 47–57, 1989 Massachusetts Institute of Technology.

* cited by examiner

*Primary Examiner*—Minsun Oh Harvey
*Assistant Examiner*—Brian Pendleton
(74) *Attorney, Agent, or Firm*—Van Pelt & Yi LLP

(57) ABSTRACT

Determining a time delay between a first signal received at a first sensor and a second signal received at a second sensor is described. The first signal is analyzed to derive a plurality of first signal channels at different frequencies and the second signal is analyzed to derive a plurality of second signal channels at different frequencies. A first feature detected that occurs at a first time in one of the first signal channels. A second feature is detected that occurs at a second time in one of the second signal channels. The first feature is matched with the second feature and the first time is compared to the second time to determine the time delay.

18 Claims, 8 Drawing Sheets

Basic Spectral Cross-Correlator Architecture.

Basic Spectral Cross-Correlator Architecture.

COMPUTATION OF MULTI-SENSOR TIME DELAYS

CROSS REFERENCE TO RELATED APPLICATIONS

This application is related to co-pending U.S. patent application Ser. No. 09/534,682 by Lloyd Watts filed Mar. 24, 2000 entitled: "EFFICIENT COMPUTATION OF LOG-FREQUENCY-SCALE DIGITAL FILTER CASCADE" which is herein incorporated by reference for all purposes.

FIELD OF THE INVENTION

The present invention relates generally to sound localization. Calculation of a multisensor time delay is disclosed.

BACKGROUND OF THE INVENTION

For many audio signal processing applications, it is very useful to localize sound. Sound may be localized by precisely measuring the time delay between sound sensors that are separated in space and that both receive the sound. One of the important cues used by humans for localizing the position of a sound source is the Interaural Time Difference (ITD), that is, the difference in time of arrival of sounds at the two ears, which are sound sensors separated in space. ITD is usually computed using the algorithm proposed by Lloyd A. Jeffress in "A Place Theory of Sound Localization," J. Comp. Physiol. Psychol., Vol. 41, pp. 35–39 (1948), which is herein incorporated by reference.

FIG. 1 is a diagram illustrating the Jeffress algorithm. Sound is input to a right input 102 and a left input 104. A spectral analysis 106 is performed on the two sound sources, and the outputs from the spectral analysis subsystems are input to cross correlator 108 which includes an array of delay lines and multipliers that produce a set of correlation outputs. This approach is conceptually simple, but requires many computations to be performed in a practical application. For example, for sound sampled at 44.1 kHz, with a 600-tap spectral analysis, and a 200-tap cross-correlator size (number of delay stages), it would be necessary to perform 5.3 Billion multiplications/second.

In order for sound localization to be practically included in audio signal processing systems that would benefit from it, it is necessary for a more computationally feasible technique to be developed.

SUMMARY OF THE INVENTION

An efficient method for computing the delays between signals received from multiple sensors is described. This provides a basis for determining the positions of multiple signal sources. The disclosed computation is used in sound localization and auditory stream separation systems for audio systems such as telephones, speakerphones, teleconferencing systems, and robots or other devices that require directional hearing.

It should be appreciated that the present invention can be implemented in numerous ways, including as a process, an apparatus, a system, a device, a method, or a computer readable medium such as a computer readable storage medium or a computer network wherein program instructions are sent over optical or electronic communication links. Several inventive embodiments of the present invention are described below.

In one embodiment, determining a time delay between a first signal received at a first sensor and a second signal received at a second sensor includes analyzing the first signal to derive a plurality of first signal channels at different frequencies and analyzing the second signal to derive a plurality of second signal channels at different frequencies. A first feature detected that occurs at a first time in one of the first signal channels. A second feature is detected that occurs at a second time in one of the second signal channels. The first feature is matched with the second feature and the first time is compared to the second time to determine the time delay.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION

A detailed description of a preferred embodiment of the invention is provided below. While the invention is described in conjunction with that preferred embodiment, it should be understood that the invention is not limited to any one embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

Figure 1:
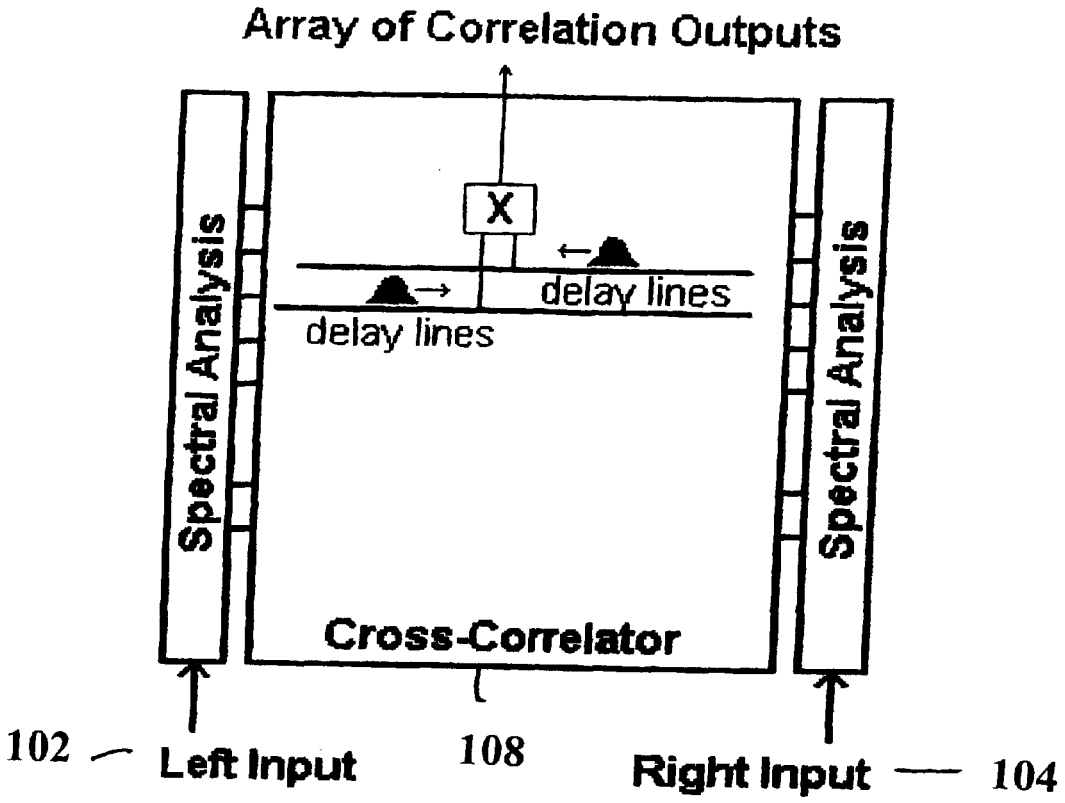
FIG. 1 is a diagram illustrating the Jeffress algorithm.
Figure 2:
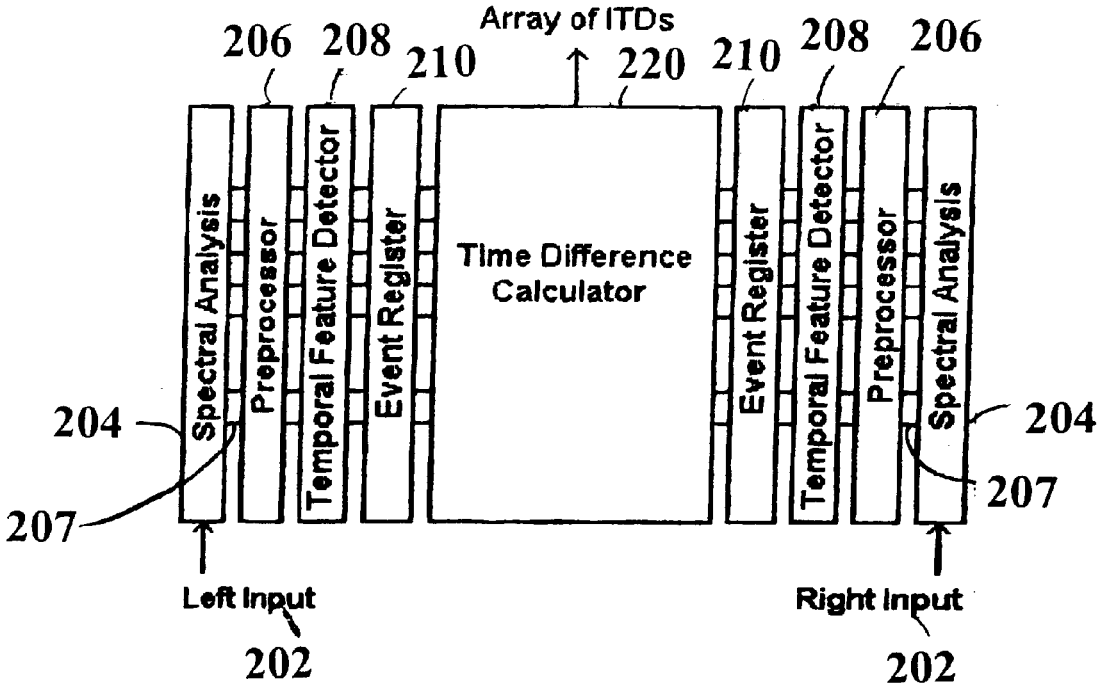
FIG. 2 is a diagram illustrating a system for calculating a time delay between two sound sensors that receive a signal.

FIG. 2 is a diagram illustrating a system for calculating a time delay between two sound sensors that receive a signal. A signal source produces a signal that is received by sensors 202. The signal from each sensor is input to a spectrum analyzer 204. Each spectrum analyzer processes the signal from its inputs and outputs the processed signal which includes a number of separated frequency channels to temporal feature detector. The spectrum analyzer may be implemented in a number of different ways, including Fourier Transform, Fast Fourier Transform, Gammatone filter banks, wavelets, or cochlear models. A particularly useful implementation is the cochlear model described in U.S. patent application Ser. No. 09/534,682 by Lloyd Watts filed Mar. 24, 2000 entitled: "EFFICIENT COMPUTATION OF LOG-FREQUENCY-SCALE DIGITAL FILTER CASCADE" which is herein incorporated by reference for all purposes. In one embodiment, a preprocessor 206 is used between the spectrum analyzer and a temporal feature detector 208. This preprocessor is configured to perform onset emphasis to eliminate or reduce the effect of environmental reverberations. In one embodiment, onset emphasis is achieved by passing the spectrum analyzer channel output through a high-pass filter. In another embodiment, onset emphasis is achieved by providing a delayed inhibition, such that echoes arriving after a certain amount of time are suppressed.

The signal output from the spectrum analyzer is provided on a plurality of taps corresponding to different frequency bands (channels), as shown by the separate lines 207. In one embodiment, a digital filter cascade is used for each spectrum analyzer. Each filter cascade has n filters (not shown) that each respond to different frequencies. Each filter has an output connected to an input of the temporal feature detector or to an input of the preprocessor which in turn processes the signal and passes it to the temporal feature detector. Each filter output corresponds to a different channel output.

The temporal feature detector detects features in the signal and passes them to an event register 210. As the event register receives each event, the event register associates a timestamp with the event, and passes it to time difference calculator 220. When the time difference calculator receives an event from one input, it matches it to an event from the other input, and computes the time difference. This time difference may then be used to determine the position of the signal source, such as in azimuthal position determination systems and sonar (obviating the need for a sonar sweep).

The temporal feature detector greatly reduces the processing required compared to a system that correlates the signals in each of the frequency channels. Feature extraction, time stamping, and time comparison can be far less computationally intensive than correlation which requires a large number of multiplications.

Figure 3:
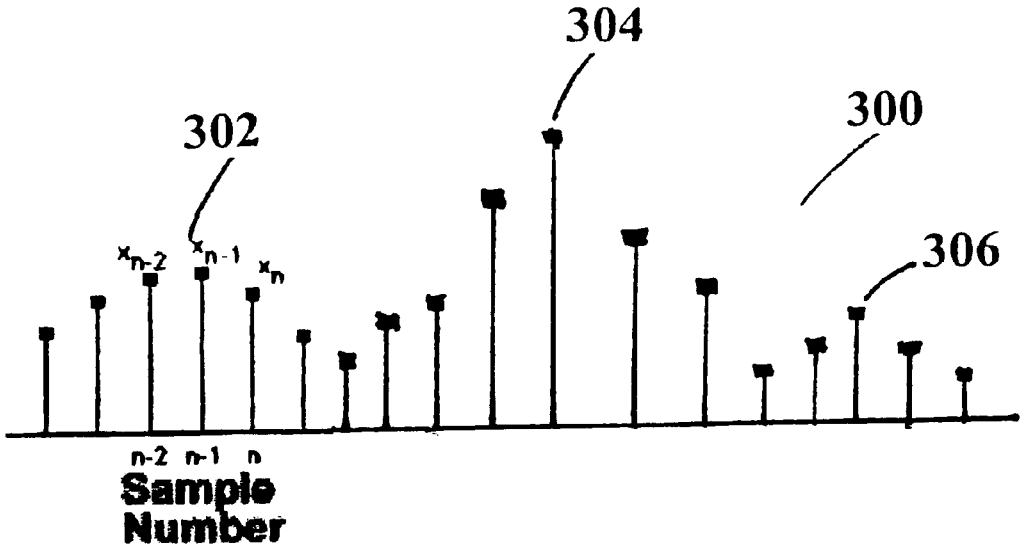
FIG. 3 is a diagram illustrating a sampled signal 300 corresponding to one of the output channels of the spectrum analyzer that is input to the temporal feature detector.

FIG. 3 is a diagram illustrating a sampled signal 300 corresponding to one of the output channels of the spectrum analyzer that is input to the temporal feature detector. The temporal feature detector is configured to detect features in the sampled waveform at a corresponding output tap from the spectrum analyzer. Some of the features of signal 300 that may be detected by the feature detector are signal peaks (local maximums) 302, 304, and 306. In other embodiments, other features such as zero crossings or local minimums are detected.

In detecting a feature, it is desirable to obtain the exact time that a feature occurs, and to accurately obtain a parameter that characterizes or distinguishes the feature. In one embodiment, signal peaks are used as a feature that is detected. The amplitude of each peak may also be measured and used to characterize each peak and to distinguish it from other peaks. A number of known techniques can be used to detect peaks. In one embodiment, peaks are detected by applying the following criteria:

$$x_{n-1}>x_n \text{ and } x_{n-1}>x_{n-2}$$

Figure 4A:
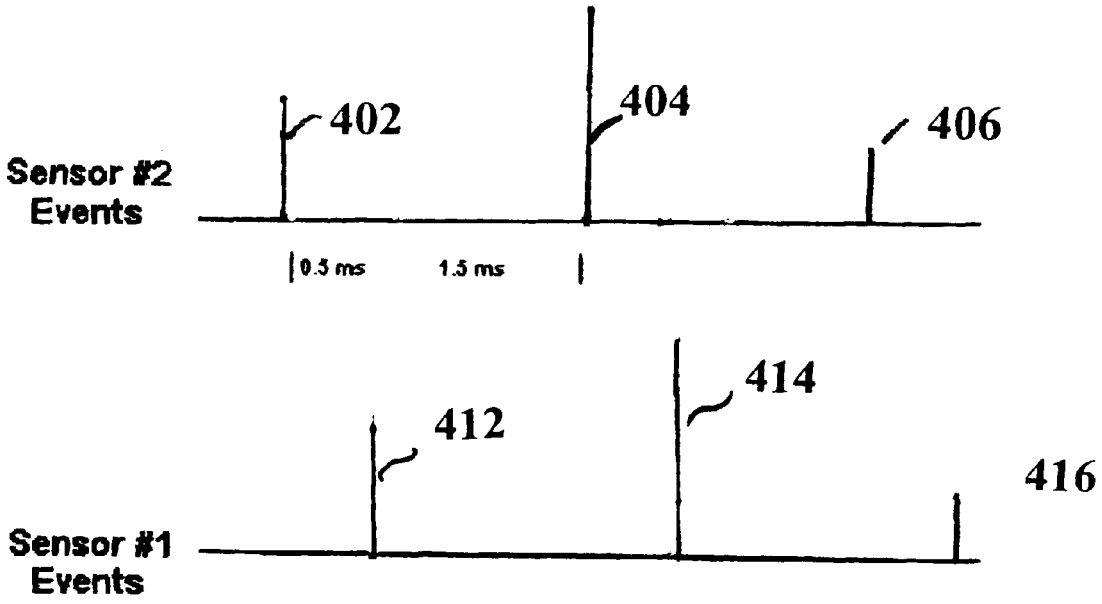
FIG. 4A is a graph depicting the output of one frequency channel for each of two sensors.

FIG. 4A is a graph depicting the output of one frequency channel for each of two sensors. The channel output shown for Sensor 2 includes three peaks, 402, 404, and 406, each having a different height. Likewise, the channel output for Sensor 1 includes three peaks, 412, 414, and 416 that correspond to the peaks, detected by Sensor 2 with a different time delay caused by the physical separation between the two sensors. In one embodiment, each peak is detected using an appropriate method and the time and amplitude of each detected peak event is reported to the event register. Other types of events may be detected and reported as well.

Figure 5:
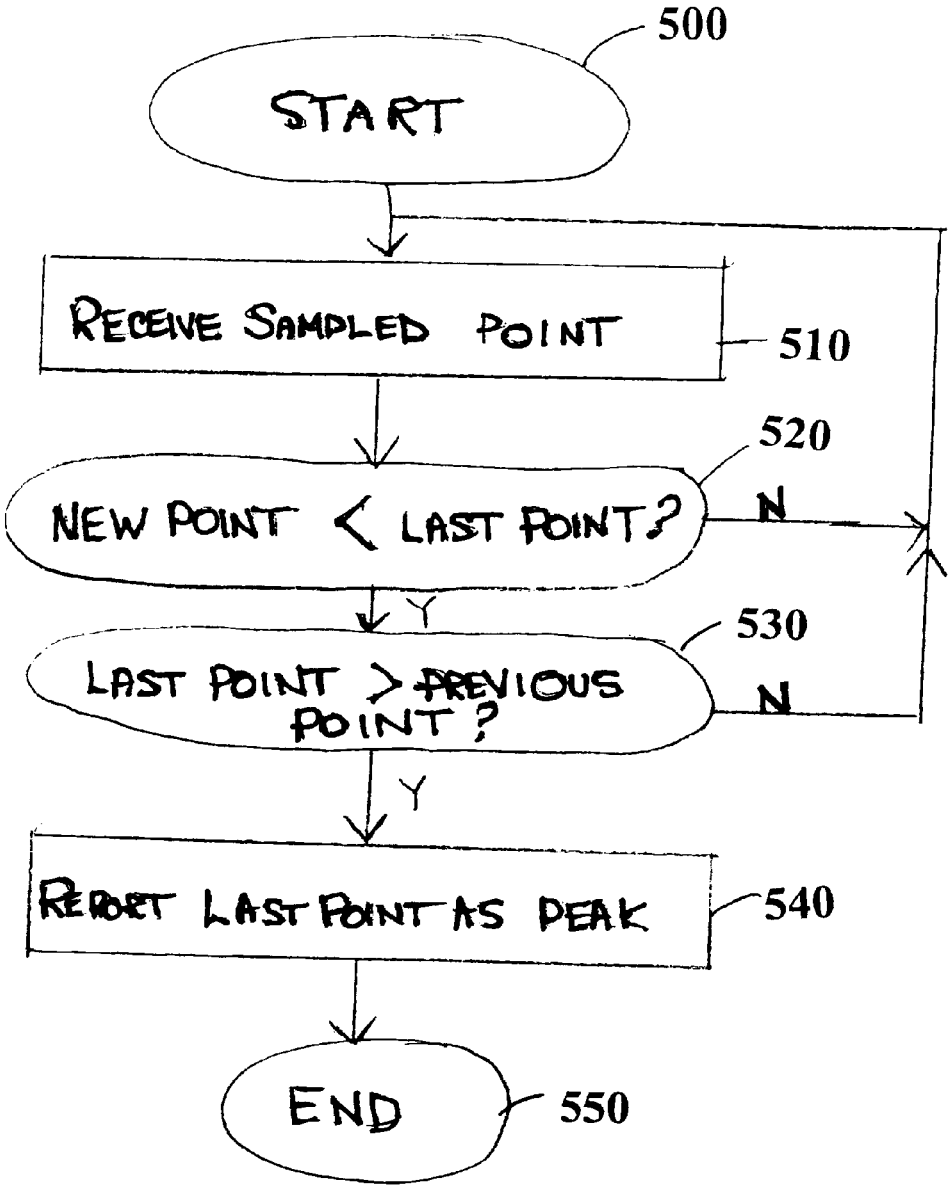
FIG. 5 is a flow chart illustrating how a peak event is detected and reported to the event register in one embodiment.

FIG. 5 is a flow chart illustrating how a peak event is detected and reported to the event register in one embodiment. The process starts at 600. In step 610, the system receives a sampled point from the channel and assigns a timestamp to it. In step 620, the system determines whether the amplitude of sampled point $x_n$ is less than the amplitude of the preceding sampled point $x_{n-1}$. In the event that it is, then control is transferred to step 630 and the system determines whether the amplitude of the preceding sampled point $x_{n-1}$ is less than the amplitude of the sampled point $x_{n-2}$ preceding it. In the event that it is, control is transferred to step 640 and $x_{n-1}$ is reported as a peak, along with its timestamp and, optionally, its amplitude.

The peak-finding method described above is appropriate when it is only necessary to obtain nearest-sample accuracy in the timing or the amplitude of the waveform peak. In some situations, however, such as when the spectral analysis step is performed by a progressively downsampled cochlea model as described in "EFFICIENT COMPUTATION OF LOG-FREQUENCY-SCALE DIGITAL FILTER CASCADE" by Watts, which was previously incorporated by reference, it may be useful to use a more accurate peak finding method based on quadratic curve fitting. This is done by using the method described above to identify three adjacent samples containing a local maximum, and then fitting a quadratic curve to the three points to determine the temporal position (to subsample accuracy) and the amplitude of the peak.

In some embodiments, the temporal feature detector is configured to detect valleys. A number of techniques are used to detect valleys. In one embodiment, the following criteria is applied:

$$x_{n-1}<x_n \text{ and } x_{n-1}<x_{n-2}$$

The valley event $x_{n-1}$ is reported to the event register just as a peak event is reported. As with a peak event, the amplitude of the valley event may be measured and recorded for the purpose of characterizing the valley event.

The temporal feature detector may also be configured to detect zero crossings. In one embodiment, the temporal feature detector detects positive going zero crossings by looking for the following condition:

$$x_n>0 \text{ and } x_{n-1}\leq 0$$

The system receives a sampled point $x_n$ and assigns a timestamp to it. If the amplitude of the sampled point $x_n$ is greater than zero, the system further checks whether the amplitude of the preceding sampled point $x_{n-1}$ is less than or equal to zero. If this is the case, the event $x_n$ (or $x_{n-1}$ if equal to zero) may be reported to the event register. Linear interpolation may be used to more exactly determine the time of zero crossing. The time of the zero crossing is reported to the event register, which uses that time to assign a timestamp to the event. If negative going zero crossings are also detected, then the fact that the zero crossing is a positive going one may also be reported to characterize and possibly distinguish the event.

The zero crossing method has the advantage of being able to use straight-line interpolation to find the timing of the zero crossing with good accuracy, because the shape of the waveform tends to be close to linear in the region near the zero. The peak-finding method allows the system to obtain a reasonably accurate estimate of recent amplitude to characterize the event.

Time difference calculator 220 retrieves events from the event registers, matches the events, and computes the multisensor time delay using the timestamps associated with the events. The time delay between individual events may be calculated or a group of events (such as periodically occurring peaks) may be collected into an event set that is compared with a similar event set detected from another sensor for the purpose of determining a time delay. Just as individual events may be identified by a parameter such as amplitude, a set of events may be identified by a parameter such as frequency or a pattern of amplitudes. Referring back to FIG. 4A, there is some ambiguity as to whether Sensor 2 leads Sensor 1 by 0.5 ms or whether Sensor 1 leads Sensor 2 by 1.5 ms. One method of resolving the ambiguity if the amplitude or some other property of each event is different is to match events between sensors that have similar amplitudes or amplitude patterns.

Figure 4B:
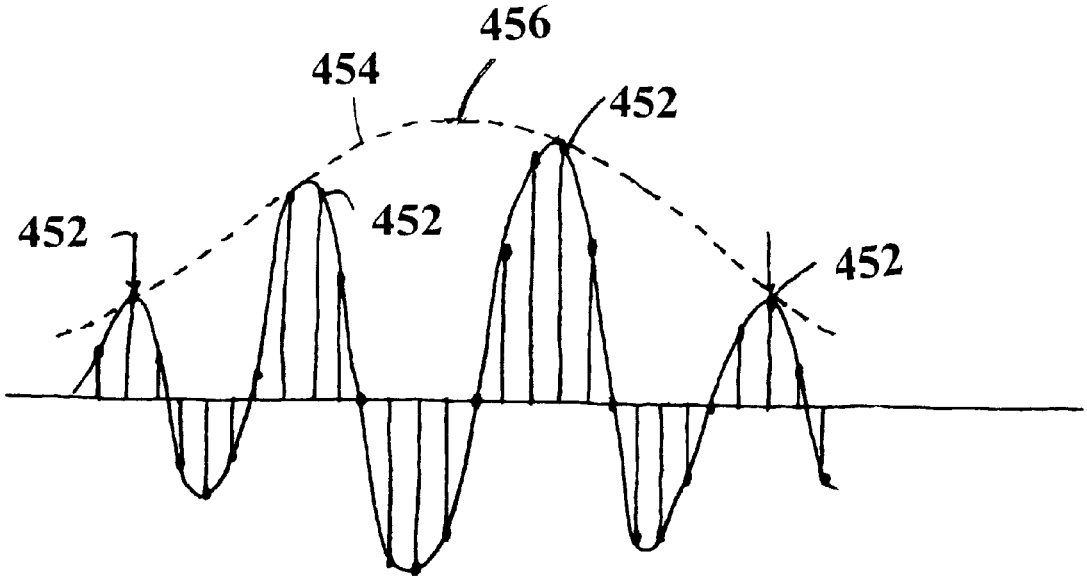
FIG. 4B is a diagram illustrating a sampled signal that contains a plurality of local peaks.

Other methods of matching events or sets of events may be used. In one embodiment, the envelope function of a group of peaks is determined and the peak of the envelope function is used as a detected event. FIG. 4B is a diagram illustrating a sampled signal that contains a plurality of local peaks 452. Local peaks 452 vary in amplitude and the amplitude variation follows a peak envelope function 454. Peak envelope has a maximum at 456, which does not correspond to a local peak, but nevertheless represents a maximum for the envelope function for a collective event that comprises the group of local peaks. In one embodiment, a quadratic method is used to find the local peaks, and then another quadratic method is used to find the peak of the peak envelope function. This method of defining an acoustic event is useful for many acoustic signals where significant events tend to include several cycles. The envelope of the cycles is likely to be the most identifiable event.

In general, this technique is useful for high frequency signals where the period is small compared to the delay. There may be several events in one channel before the first event arrives at a second channel. An ambiguity occurs as to which events in either channel correspond to each other. However, the envelope of the events varies more slowly and peaks may not occur as often, so that corresponding events occur less frequently and the ambiguity may be solved. In another embodiment, instead of detecting the envelope, the largest event in a group of events is selected. The result is similar, except that the event is detected at a local peak, instead of at the maximum of the envelope function, which does not necessarily occur at a local peak.

In some embodiments, a more computationally expensive alternative to using the peak envelope function is used. The amplitudes of the local peaks are correlated. While this is less computationally expensive than correlating the signals, the peak of the peak envelope function is preferred because it requires less computing and provides good results.

In one embodiment, the time difference calculator, as it matches the events from each sensor, also determines which sensor detects events first. For certain periodic events, determining which sensor first detects an event may be ambiguous. Referring again back to FIG. 4A, if the amplitudes do not differ or are not used to distinguish events, then an ambiguity occurs as to which sensor first detects an event. In the example shown, the frequency is 500 Hz, giving a period of 2 ms. Events from the signal received by sensor #1 follow events from the signal received by sensor #2 by 0.5 ms. But events from sensor #2 can also be seen to be following events from sensor #1 by 1.5 ms. This means that either signal #1 leads signal #2 by 1.5 ms, or signal #2 leads signal #1 by 0.5 ms.

In one embodiment, the ambiguity is resolved by defining a maximum multisensor time delay that is possible. Such a maximum may be derived physically from the maximum allowed separation between the sensors. For example, if the sensors are placed to simulate a human head, the maximum multisensor time delay is approximately 0.5 ms, based on the speed of sound in air around a person's head. Thus, the 1.5 ms result is discarded, and the 0.5 ms result (signal 2 leads signal 1) is returned as the time delay. An indication may also be returned that signal 2 leads signal 1.

Figure 6:
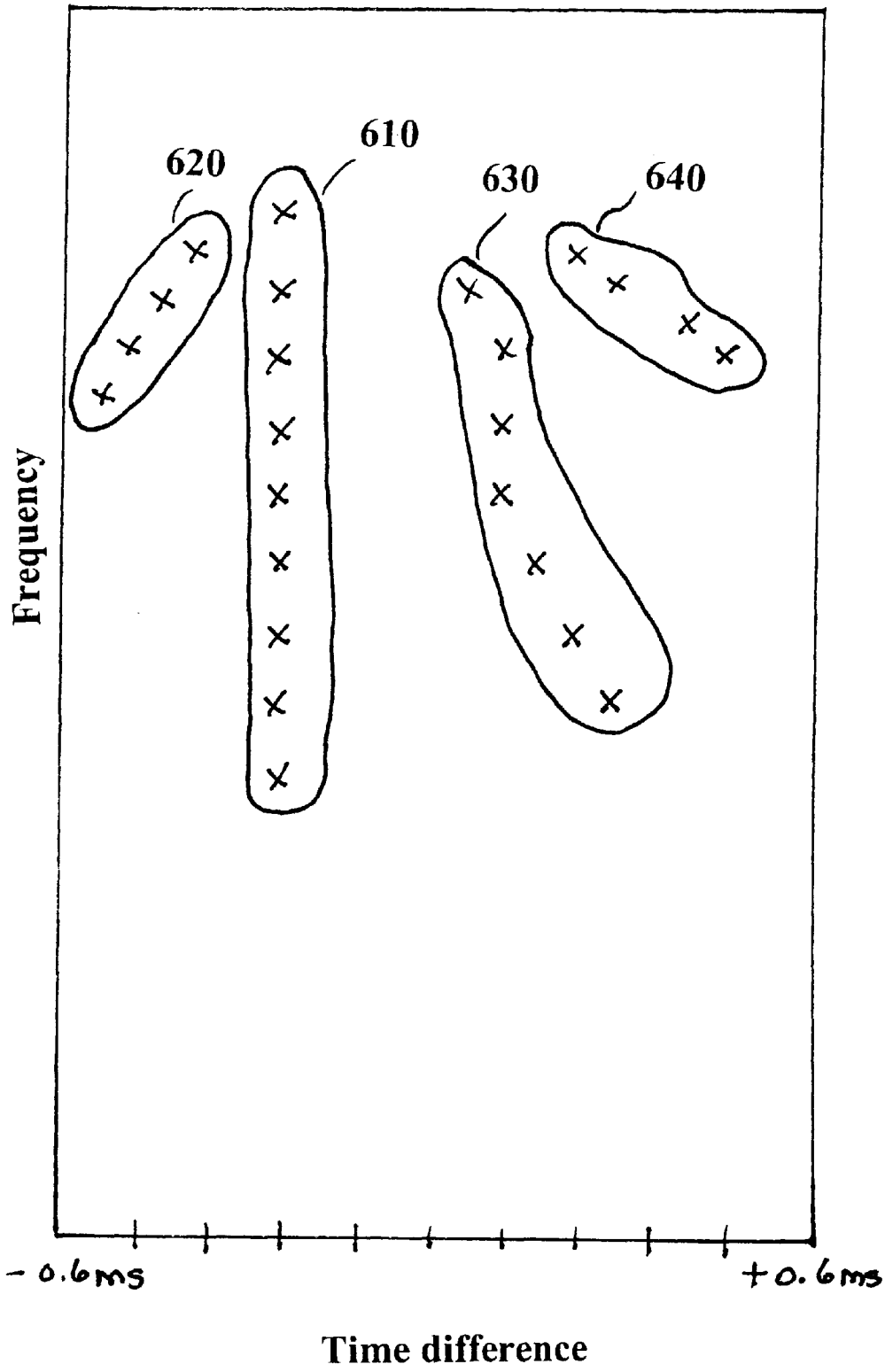
FIG. 6 is a diagram illustrating a sample output of the system. The time delay for events measured in each channel is plotted against the frequency of each channel.

FIG. 6 is a diagram illustrating a sample output of the system. The time delay for events measured in each channel is plotted against the frequency of each channel. Events detected on different channels are grouped and analyzed to determine whether they correspond to a single sound source. The example shown includes event groups 610, 620. 630, and 640. Event group 610 includes events that all occurred at about −0.2 ms. The common multisensor time delay calculation across all frequencies indicates that it corresponds to a single sound source. In general, events at different frequency channels that arrive at approximately the same time are likely coming from a common source. The other groups likely represent ambiguities which naturally occur at high frequencies (for which the delay is longer than the period) and can be discarded.

The system groups events detected on different frequency channels and evaluates the groups to determine which groups correspond to a single sound source. In one embodiment, groups are formed by considering all events that are within a set time difference of other events already in the group. For example, all events within a 33 ms video frame are considered in one embodiment.

In one embodiment, an event group is evaluated by computing the standard deviation of the points. If the standard deviation is less than a threshold, then the group is identified as corresponding to a single source and the time delay is recorded for that source. In one embodiment, ratio of the standard deviation to the frequency is compared to a threshold. In some embodiments, the average time delay of the events included in the event group is recorded. In some embodiments, certain events, such as events with a time outside the standard deviation in the group are excluded in calculating time delay for the source.

In other embodiments, other methods are used to automatically decide whether a group of events on different channels correspond to a single source. In one embodiment, the range of the points is compared to a maximum range. In one embodiment, it is determined whether there is a consistent trend in one direction or another with change in frequency. More complex pattern recognition techniques may also be used. In one embodiment, a two dimensional filter that has a strong response when there is a vertical line (see FIG. 6) of aligned events occurring at the same time across different frequencies, with inhibition on either side of the vertical line. This results in accentuation of vertically aligned events such as event 610 and rejection of the sloped/ambiguous events such as events 620,630 and 640.

The multisensor time delay is a strong cue for the azimuthal position of sound sources located around a sensor array. The method of calculating time delay disclosed herein can be applied to numerous systems where a sound source is to be localized. In one embodiment, a sound source is identified and associated with a time delay as described above. The identification is used to identify a person that is speaking based on continuity of position. In one embodiment, a moving person or other sound source of interest is tracked by monitoring ITD measurements over time and using a tracking algorithm to track the source. In one embodiment, a continuity criteria is prescribed for a source that determines whether or not a signal is originating from the source. In one embodiment, the continuity criteria is that the ITD measurement may not change by more than a maximum threshold during a given period of time. In another embodiment where sources are tracked, continuity of the tracked path is used as a continuity criteria. In other embodiments, other continuity criteria are used. The identification may be used to separate the sound source from background sound by filtering out environmental sound that is not emanating from the person or other desired sound source. This may be used in a car (for telematic applications), a conference room, a living room, or other conversational or voice-command situation. In one application used for teleconferencing, a video camera is automatically trained on a speaker by localizing the sound from the speaker using the source identification and time delay techniques described herein.

Figure 7:
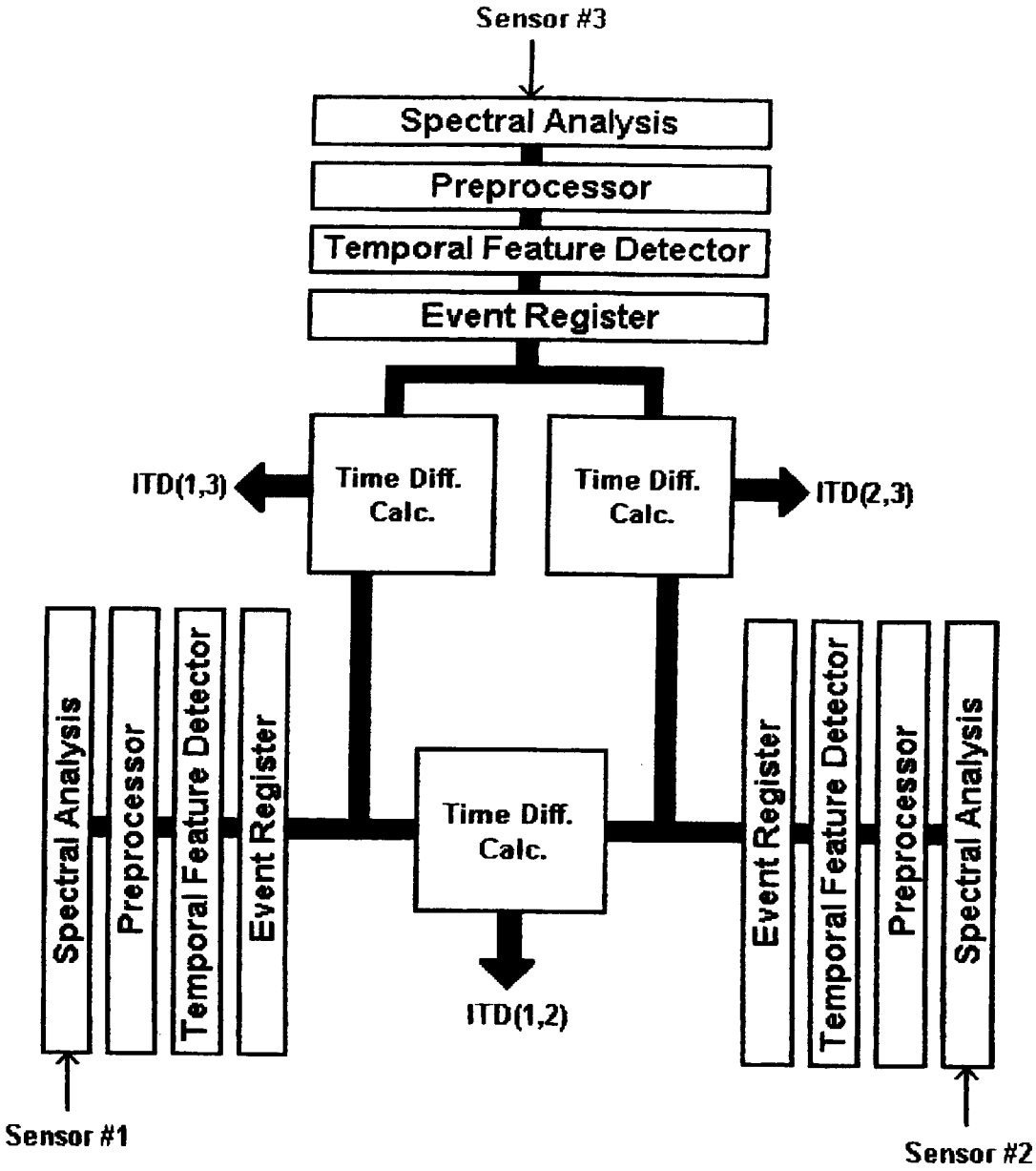
FIG. 7 is a block diagram illustrating a configuration used in one embodiment where three sensors are used with three time difference calculations being determined.

FIG. 7 is a block diagram illustrating a configuration used in one embodiment where three sensors are used with three time difference calculations being determined. The signal from each sensor is processed in a manner as describe above to detect and register the time of events. A time difference calculator is provided to determine the time difference between events detected at each sensor. The three time differences can be used to determine sound source position with greater accuracy. Three or more sensors may be arranged in a planar configuration or multiple sensors may be arranged in multiple planes.

In one embodiment, the time difference is calculated to identify the driver's position as a sound source within an automobile. Sounds not emanating from the driver's position (e.g. the radio, the vent, etc.) are filtered so that background noise can be removed when the driver is speaking voice commands to a cell phone or other voice activated system. The approximate position of the driver's voice may be predetermined and an exact position learned over time as the driver speaks.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims. For example, embodiments having two and three sensors have been described in detail. In other embodiments, the disclosed techniques are used in connection with more than three sensors and with varying configurations of sensors.

What is claimed is:

1. A method of determining a time delay between a first signal received at a first sensor and a second signal received at a second sensor comprising:

analyzing the first signal to derive a plurality of first signal channels at different frequencies;

analyzing the second signal to derive a plurality of second signal channels at different frequencies;

detecting a first feature occurring at a first time in one of the first signal channels;

detecting a second feature occurring at a second time in one of the second signal channels;

matching the first feature having a first timestamp applied based on a first event with the second feature having a second timestamp applied based on a second event;

comparing the first time to the second time to determine the time delay; and associating the time delay with a continuity criteria to determine whether the first signal and the second signal originates from a sound source and to track the sound source.

2. A method of determining a time delay as recited in claim 1 wherein the first feature includes a signal local maximum.

3. A method of determining a time delay as recited in claim 1 wherein the first feature includes a set of signal local maximums.

4. A method of determining a time delay as recited in claim 1 wherein the first feature includes a signal local minimum.

5. A method of determining a time delay as recited in claim 1 wherein the first feature is a signal local maximum and wherein the amplitude of signal local maximum is used to match the first feature with the second feature.

6. A method of determining a time delay as recited in claim 1 wherein the first feature is a signal local maximum and wherein the signal local maximum is interpolated from sampled points.

7. A method of determining a time delay as recited in claim 1 wherein the first feature is a zero crossing.

8. A method of determining a time delay as recited in claim 1 wherein the first feature is a zero crossing and wherein whether the zero crossing is positive going or negative going is used to match the first feature with the second feature.

9. A method of determining a time delay as recited in claim 1 wherein the first feature is a peak of an envelope function.

10. A method of determining a time delay as recited in claim 1 further including matching a plurality of features in a plurality of channels and determining a plurality of time delays and comparing the time delays to derive a single time delay that corresponds to a single source.

11. A method of determining a time delay as recited in claim 1 further including matching a plurality of features in a plurality of channels and determining a plurality of time delays and comparing the time delays to validate the event time delay.

12. A method of determining a time delay as recited in claim 1 wherein the time delay is used to localize a sound source.

13. A method of determining a time delay as recited in claim 1 wherein the time delay is used to localize a sound source for and a video camera is configured to point at the sound source.

14. A method of determining a time delay as recited in claim 1 wherein the time delay is used to localize a sound source and background sounds not emanating from the source are filtered.

15. A method of determining a time delay as recited in claim 1 wherein matching the first feature with the second feature includes imposing a maximum possible time delay to remove ambiguities.

16. A method of determining a time delay as recited in claim 1 wherein the first feature and the second feature are periodic and wherein comparing the first time to the second time to determine the time delay includes imposing a maximum possible time delay to determine which feature preceded the other.

17. A system for determining a time delay between a first signal and a second signal comprising:

a first sensor that receives the first signal;

a second sensor that receives the second signal;

a spectrum analyzer that analyzes the first signal to derive a plurality of first signal channels at different frequencies and that analyzes the second signal to derive a plurality of second signal channels at different frequencies;

a feature detector that detects a first feature occurring at a first time in one of the first signal channels and that detects a second feature occurring at a second time in one of the second signal channels;

an event register that records the occurrence of the first feature and the second feature; and a time difference calculator that compares the first time to the second time to determine the time delay, matching the first feature having a first timestamp applied based on a first event with the second feature having a second timestamp applied based on a second event, and associating the time delay with a continuity criteria to determine whether the first signal and the second signal originates from a sound source and to track the sound source.

18. A computer program product for determining a time delay between a first signal received at a first sensor and a second signal received at a second sensor, the computer program product being embodied in a computer readable medium and comprising computer instructions for:

analyzing the first signal to derive a plurality of first signal channels at different frequencies;

analyzing the second signal to derive a plurality of second signal channels at different frequencies;

detecting a first feature occurring at a first time in one of the first signal channels;

detecting a second feature occurring at a second time in one of the second signal channels;

matching the first feature with the second feature matching the first feature having a first timestamp applied based on a first event with the second feature having a second timestamp applied based on a second event;

comparing the first time to the second time to determine the time delayed; and associating the time delay with a continuity criteria to determine whether the first signal and the second signal originates from a sound source and to track the sound source.

* * * * *

UNITED STATES PATENT AND TRADEMARK OFFICE

CERTIFICATE OF CORRECTION

PATENT NO. : 6,792,118 B2
APPLICATION NO. : 10/004141
DATED : September 14, 2004
INVENTOR(S) : Lloyd Watts It is certified that error appears in the above-identified patent and that said Letters Patent is hereby corrected as shown below:

In the Background at Column 1, Line 32-33, that portion of the sentence reading "spectral analysis 106 is performed on the two sound sources and the outputs from the spectral analysis subsystems are" should read -- spectral analysis is performed on the two sound sources and the outputs from spectral analysis subsystems 106 are --

In the Brief Description of the Drawings at Column 2, Line 24, that portion of the sentence reading "sampled signal 300" should read -- sampled signal --

In the Detailed Description at Column 4, Line 13, that portion reading "The process starts at 600. In step 610, the system" should read -- The process starts at 500. In step 510, the system --

In the Detailed Description at Column 4, Line 15, that portion of the sentence reading "In step 620, the system" should read -- In step 520, the system --

In the Detailed Description at Column 4, Line 18, that portion of the sentence reading "to step 630 and the system" should read -- to step 530 and the system --

In the Detailed Description at Column 4, Line 22, that portion of the sentence reading "step 640 and" should read -- step 540 and --

Signed and Sealed this

Twenty-sixth Day of September, 2006

JON W. DUDAS
*Director of the United States Patent and Trademark Office*